US005549751A

United States Patent [19]

Brinkmeier et al.

[11] Patent Number: 5,549,751

[45] Date of Patent: Aug. 27, 1996

[54] ADHESIVE APPLICATOR

[75] Inventors: Friedhelm Brinkmeier; Richard Feldkämper, both of Lengerich, Germany

[73] Assignee: Windmoeller & Hoelscher, Lengerich/Westf., Germany

[21] Appl. No.: 227,708

[22] Filed: Apr. 14, 1994

Related U.S. Application Data

[63] Continuation of Ser. No. 987,836, Dec. 9, 1992, abandoned.

[30] Foreign Application Priority Data

Dec. 11, 1991 [DE] Germany ..... 41 40 835.7

[51] Int. Cl.[6] ..... B05C 1/00

[52] U.S. Cl. ..... 118/216; 118/262

[58] Field of Search ..... 118/212, 216, 118/221, 262, 259, 261, 250

[56] References Cited

U.S. PATENT DOCUMENTS

| | | | |
|---|---|---|---|
| 244,125 | 7/1881 | Hammerl | 118/261 |
| 2,386,731 | 8/1948 | Wenzelberger . | |
| 2,603,077 | 7/1952 | Dungler | 118/244 |
| 2,970,564 | 2/1961 | Warner | 118/261 |
| 3,006,317 | 10/1961 | Showalter | 118/212 |
| 3,162,545 | 12/1964 | Dearsley | 118/261 |
| 3,356,062 | 12/1967 | Crowe | 118/261 |
| 3,688,736 | 9/1972 | Beck et al. | 118/262 |
| 4,357,896 | 11/1982 | Feldkamper | 118/262 |

FOREIGN PATENT DOCUMENTS

| | | | |
|---|---|---|---|
| 1133232 | 7/1962 | Germany . | |
| 2948745 | 6/1981 | Germany . | |
| 3105020 | 9/1982 | Germany . | |
| 90703 | 4/1959 | Netherlands | 118/212 |
| 2064433 | 6/1981 | United Kingdom | 118/212 |

*Primary Examiner*—Brenda A. Lamb
*Attorney, Agent, or Firm*—Keck, Mahin & Cate

[57] ABSTRACT

An adhesive applicator comprising a transfer roller is provided with a uniform layer of glue and is set against a format roller such that application members distributed over its periphery pick up glue applied in a certain format and transfer the same to workpieces to be coated with glue. To prevent that glue thrown off from the application members contaminates the apparatus and gets lost, a collection roller (2) is disposed in direction of rotation of the format roller (14) before the transfer roller (1), which collection roller forms a troughlike nip with said transfer roller (1).

5 Claims, 1 Drawing Sheet

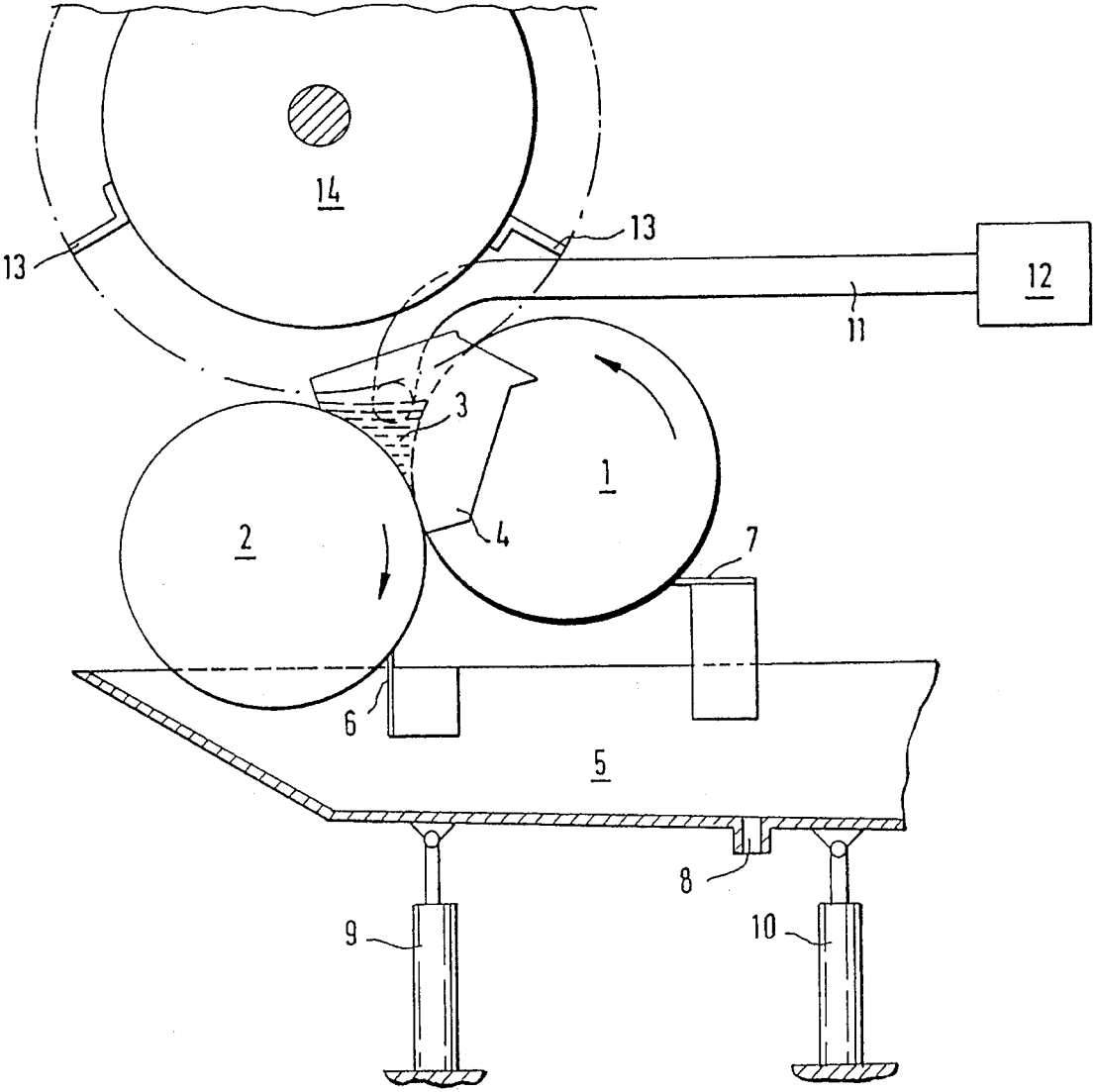
12
11
13
7
1
4
3
14
13
5
8
10
6
2
9

ADHESIVE APPLICATOR

This is a continuation application of Ser. No. 07/987,836, filed Dec. 9, 1992, now abandoned.

FIELD OF THE INVENTION

The invention relates to an adhesive applicator comprising a transfer roller, which can be provided with a uniform layer of glue and can be set against a format roller such that its application members, which are distributed over its periphery, pick up glue applied thereto in a certain format and transfer the same to workpieces to be coated with glue.

BACKGROUND OF THE INVENTION

In an adhesive applicator of this type known from the DE-PS 29 48 745, which can also be operated with horizontally disposed rollers, part of the glue picked up by the application members can be thrown off again. This excess amount of picked-up glue, which has been thrown off again, is collected by a splashboard. Glue then dries onto said splashboard, so that the same must be cleaned from time to time with considerable effort. A further disadvantage of the known adhesive applicator is that a relatively high percentage of the glue picked up in excess by the application members can be thrown off and not be reused thereafter, so that there is a high loss of non-usable glue.

SUMMARY OF THE INVENTION

It is therefore the object of the invention to improve an adhesive applicator of the above-mentioned type such that glue thrown off from the application members does not contaminate the apparatus and must be regarded as a loss, but can be used again.

In accordance with the invention this object is solved in an apparatus of the generic kind in that in direction of rotation of the format roller before the transfer roller a collection roller is mounted, which together with the transfer roller forms a troughlike nip. Since due to the centrifugal forces causing the throwing off excess glue picked up from the application members is thrown off again immediately after it has been picked up, said glue portion thrown off is collected by the collection roller and is returned for reusage to the nip formed between the collection roller and the transfer roller.

Expediently, the collection roller is set against the format roller so closely that its application members just do not touch the collection roller. By means of this arrangement a large throw-off area is covered by the collection roller, and there are also avoided gaps between the collection roller and the format roller, through which glue could spurt out.

Expediently, sealing plates are set against the faces of the transfer and collection rollers for closing the troughlike nip formed between the same.

A line supplying glue or flushing agent can open into said troughlike nip.

Expediently doctor blades are set against said transfer and collection rollers in a manner known per se.

Below said transfer and collection rollers a collection trough can be arranged, to which glue scraped off is returned, and from which the same is then withdrawn to be supplied again.

BRIEF DESCRIPTION OF THE DRAWING

One embodiment of the invention will subsequently be explained in detail by means of the drawing, in whose only Figure a glue application system is schematically represented in a side view.

A glue roller 1 transferring a glue layer is set against a counter-roller 2 constituting a collection roller.

DETAILED DESCRIPTION OF THE PREFERRED EMBODIMENTS

The upper intake gap formed by the two rollers 1 and 2 serves as an open a trough 3 for the glue, where the intake gap is sealed at its face by sealing plates 4. Below the two rollers 1 and 2 a collection trough 5 is provided, which is equipped with doctor blades 6 and 7. The doctor blade 6 is associated to the collection roller 2, and the doctor blade 7 is associated to the transfer roller 1. As can furthermore be seen from the Figure, the collection trough 5 has a discharge port 8 and can be lowered by means of piston cylinder units 9 and 10. Above the collection trough 5 and above the rollers 1 and 2 a supply line 11 is provided, through which depending on the position of the change-over valve 12 either glue or flushing water can be introduced into the trough-like nip, which is formed by the rollers 1 and 2. During the transfer of glue the glue application segments 13, which are disposed at the periphery of a format roller 14, get in contact with the surface of the glue roller 1 during the rotation of said format roller, and pick up glue from said glue roller. Part of said picked-up glue is thrown off due to the peripheral speed of the format roller 14 and the glue application segments 13. Said thrown-off portion is supplied to the glue trough 3 due to the arrangement of the rollers 1, 2 and 14 with respect to each other, so that the glue portion thrown off from the segments 13 can neither contaminate machine elements nor can be regarded as waste.

What is claimed is:

1. An adhesive applicator comprising a transfer roller (1) for providing with a uniform layer of glue and setting against a format roller (14) such that application members on said format roller (14) distributed over a periphery thereof pick up glue applied in a certain format and transfer the glue to work pieces to be coated with glue, wherein, in the direction of rotation of the format roller (14) before said transfer roller (1) a collection roller (2) is mounted, which together with said transfer roller (1) forms an open nip, said open nip serving as a trough for holding the glue, said transfer roller (1) and said collection roller (2) being arranged below a shaft of said format roller (14), wherein said format roller (14) with said application members disposed thereon is arranged relative to said collection roller (2) such that said application members are adjacent to but spaced from said collection roller (2), and wherein excess glue picked up by said application members is thrown off again immediately after the excess glue has been picked up, the glue thrown off being collected by said collection roller (2) and returned for reuse to the open nip formed between said collection roller (2) and said transfer roller (1).

2. The adhesive applicator according to claim 1, wherein against the faces of said transfer and collection rollers (1, 2) sealing plates (4) are set for closing said open nip formed between said transfer and collection rollers (1, 2).

3. The adhesive applicator according to claim 2, wherein a line (11) supplying the glue or a flushing agent opens into said open nip of said transfer and collection rollers (1, 2).

4. The adhesive applicator according to claim 1, wherein doctor blades (6, 7) are set against said transfer and collection rollers (1, 2).

5. The adhesive applicator according to claim 1, wherein below said transfer and collection rollers (1, 2) a collection trough (5) is arranged.

* * * * *